US005262019A

United States Patent [19]

Snyder et al.

[11] Patent Number: 5,262,019

[45] Date of Patent: * Nov. 16, 1993

[54] DECONTAMINATION OF RADIOACTIVE METALS

[75] Inventors: Thomas S. Snyder, Oakmont, Pa.; Laura J. Ayers, Knoxville, Tenn.; Chuck A. Cooney, Kingston, Tenn.; Gregory F. Boris, Knoxville, Tenn.; Dwight F. Goad; Kevin D. Robbins, both of Kingston, Tenn.; Darrell B. Watkins, Harriman, Tenn.

[73] Assignee: Westinghouse Electric Corp., Pittsburgh, Pa.

[ * ] Notice: The portion of the term of this patent subsequent to Oct. 20, 2009 has been disclaimed.

[21] Appl. No.: 991,807

[22] Filed: Dec. 16, 1992

[51] Int. Cl.[5] ..... C25C 1/06

[52] U.S. Cl. ..... 204/105 R; 204/112; 423/2; 423/49; 423/139

[58] Field of Search ..... 204/112, 105 R; 423/2, 423/49, 139

[56] References Cited

U.S. PATENT DOCUMENTS

| | | | |
|---|---|---|---|
| 3,853,725 | 12/1974 | Skalbo et al. | 204/112 |
| 3,891,741 | 6/1975 | Carlin et al. | 423/2 |
| 3,928,153 | 12/1975 | Gendron et al. | 204/112 |
| 4,148,621 | 4/1979 | Babjak et al. | 75/101 B |
| 4,395,315 | 7/1983 | Zabbro | 204/112 |
| 4,738,834 | 4/1988 | Moore et al. | 423/2 |
| 4,764,352 | 8/1988 | Bathellier et al. | 423/10 |
| 5,156,722 | 10/1992 | Snyder et al. | 204/112 |
| 5,183,541 | 2/1993 | Snyder et al. | 204/112 |

*Primary Examiner*—John Niebling
*Assistant Examiner*—Patrick J. Igoe
*Attorney, Agent, or Firm*—J. C. Valentine

[57] ABSTRACT

Technetium-contaminated nickel is decontaminated by electrolytically dissolving nickel having a gross beta activity of at least about 74 Bq in a sulfuric acid solution having a pH between about 0.5 and 2.0. The applied voltage is from 2.0 v/cell to 5.0 v/cell for dissolving the nickel and contaminants while cathodically producing hydrogen gas. Technetium (+4) species in the acid solution is oxidized to the technetium (+7) species. The pH of the technetium-containing acid solution is adjusted to between 2.5 to 4.5. Particulates in the acid solution are filtered from the solution for reducing the gross beta activity of the acid solution to less than about 50 Bq/gm. Radioactive ions (including technetium complexes) are sorbed in an anionic exchanger and a cationic exchanger for reducing the gross beta activity of the acid solution to less than about 20 Bq/gm. After verifying the gross beta activity of the acid solution, the acid solution is either recycled or charged to a electrowinning step. Acid solution having an activity of more than about 20 Bq/gm is recycled to upstream of the anion exchanger and the cationic exchanger. Acid solution having a gross beta activity of less than about 20 Bq/gm is charged to the electrowinning step. Nickel is plated at a voltage of about 2 v/cell to about 6 v/cell while oxygen gas is anodically generated. The pH of barren metal acid solution from the electrowinning step is reduced to less than about 2 and the barren metal acid solution is recycled for dissolving additional contaminated nickel.

7 Claims, 1 Drawing Sheet

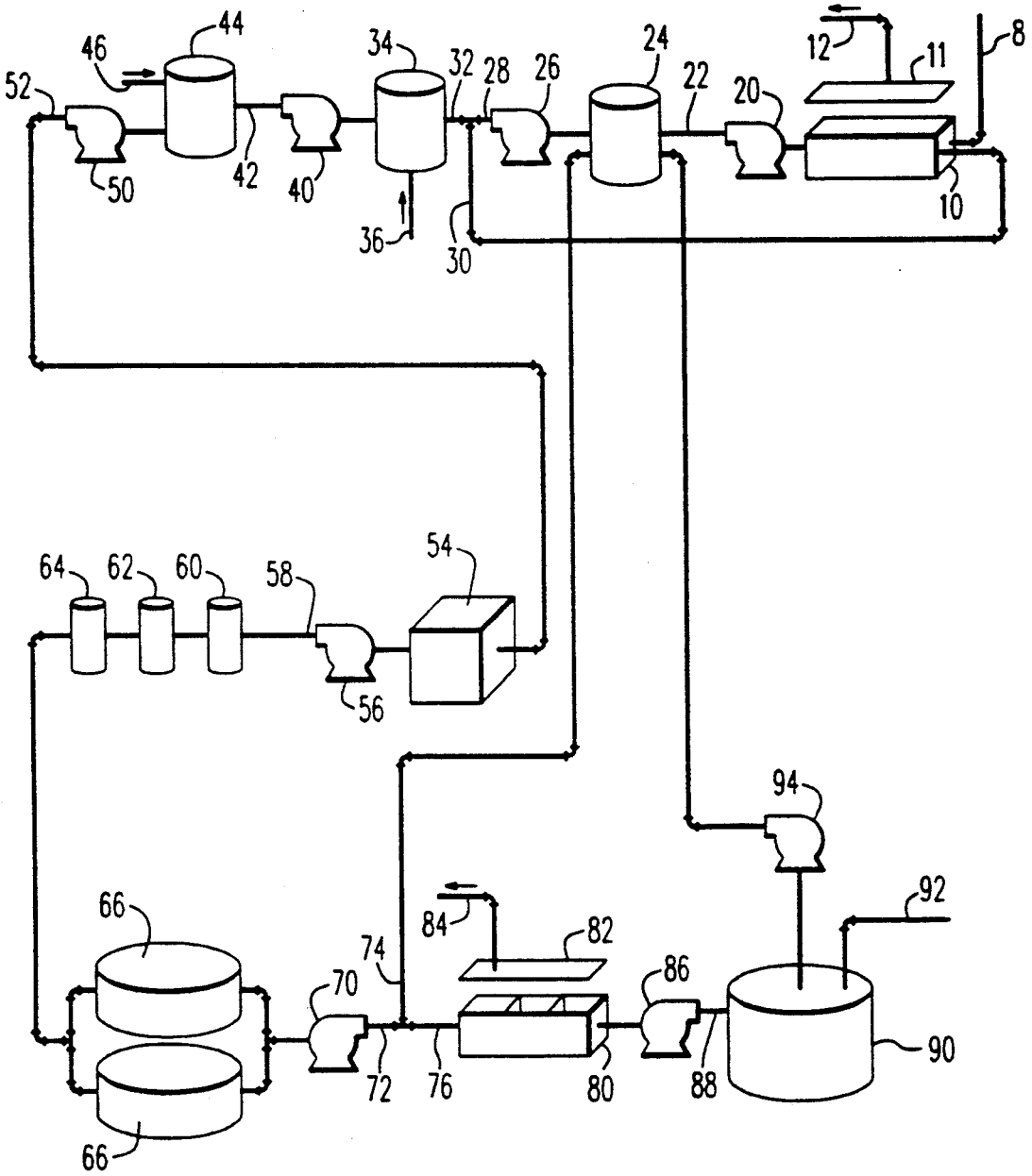
8
10
11
12
20
22
24
26
28
30
32
34
36
40
42
44
46
50
52
54
56
58
60
62
64
66
66
70
72
74
76
80
82
84
86
88
90
92
94

DECONTAMINATION OF RADIOACTIVE METALS

BACKGROUND OF THE INVENTION

1. Field of the Invention:

The present invention relates to decontamination of lightly radio-contaminated metals, and in particular to decontamination of radio-contaminated metals by reductive electrochemical processing. Of particular interest to the present invention is the remediation of radio-contaminated nickel from decommissioning the uranium gaseous diffusion cascades from the Department of Energy's K-25 Plant in which nickel is the primary constituent. Spectrochemical analyses of spot samples of the K-25 nickel indicate that the nickel is about 99.8% pure and contains small amounts of copper, iron, chromium, magnesium, silicon, cobalt, titanium, aluminum and carbon. Radiochemical analyses indicate that the K-25 nickel is contaminated with about 0.5 parts per billion (ppb) neptunium 237 or less, about 0.005 ppb plutonium 239 or less, about 0.85 parts per million (ppm) technetium, about 0.93 ppm uranium 235 and about 1.74 ppm total uranium. Also, this nickel has been determined to have gross beta activities of about 4000 Bq/gm. Therefore, it cannot be freely recycled because the international release criteria for permitting the unrestricted circulation of nickel free from governmental health control is not greater than 74 Bq/gm. The release criteria in particular countries may be as low as 0.37 Bq/gm. The decontamination art taught herein applies equally well to the recovery and decontamination of other multivalent, strategic metals which can be electrowon such as copper, cobalt, chromium, iron, zinc, aluminum and like transition metals.

2. The Prior Art:

The radiochemical decontamination art is presented with unique practical problems not shared with traditional extraction technologies. Radiochemical extraction technologies are generally concerned with the economic recovery of "product radiochemicals". Routine process inefficiencies which permit residual (ppm or less) amounts of radiochemicals to remain in process streams or in byproducts raise only normal economic issues of process yield and acceptable process costs. Such inefficiencies render these processes unacceptable where, as here, the nickel purity with respect to radionuclides must exceed 99.9999999% (or so called "nine - 9s").

Various decontamination processes are known in the art, and specifically for decontamination of nickel. Nickel can be removed by selectively stripping from an acidic solution by electrowinning. See U.S. Pat. No. 3,853,725. Nickel may also be removed by liquid-liquid extraction or solvent extraction. See U.S. Pat. Nos. 4,162,296 and 4,196,076. Further, various phosphate type compounds have been used in the removal of nickel. See U.S. Pat. Nos. 4,162,296; 4,624,703; 4,718,996; 4,528,165 and 4,808,034. In addition, electroslag processing has been proposed, but the extent of decontamination can not be verified in the course of the processing because nickel is self-shielding so that highly contaminated product must be recycled back to the beginning of the process.

It is known that metallic nickel, contaminated with fission products, can be decontaminated to remove any actinides present by direct electrochemical processing based on the differences in reduction potential in the electromotive force (emf) series. Actinide removal is favored by two phenomena during electrochemical plating. Actinides have a significantly higher reduction potential relative to nickel and they are normally won from molten salt electrolyte rather than from aqueous electrolyte. See U.S. Pat. Nos. 3,928,153 and 3,891,741, for example. Other electrolytic processes are disclosed by U.S. Pat. Nos. 3,915,828; 4,011,151; 4,146,438; 4,401,532; 4,481,089; 4,537,666; 4,615,776 and 4,792,385.

While the removal of uranium and other actinides has been generally addressed by electrorefining, the removal of technetium has continued to be a substantial problem. A major stumbling block in developing process technology for decontaminating homogeneously contaminated metals to less than about 74 Bq/gm (for recycling free of governmental controls) has been the lack of effective in-process decontamination verification and reprocessing of technetium-contaminated process streams.

SUMMARY OF THE INVENTION

It is an object of the present invention to decontaminate transition metals which are compatible with electrochemical processing in aqueous solutions, and preferably nickel, while integrating decontamination verification directly into the process design. It is a further object to track the decontamination progress through metal assays while the metal is still in the aqueous phase prior to final metallic product recovery to avoid self-shielding effects in metal analyses, which is critical in verifying purities of nine-9s plus. It is another object to effectively reprocess technetium-contaminated process streams.

With these objects in view, the present invention resides in a process for decontaminating transition metals, such as nickel from the ORNL diffusion cascades, which are contaminated with technetium and (usually) other actinides. Such metals generally have gross beta activities greater than the international release criteria of 74 Bq/gm, and up to about 4000 Bq/gm or more in the case of the ORNL nickel. The contaminated metal is electrolytically dissolved in an acid solution having a pH between about 0.5 and 2.0 at a voltage of about 2.0 v/cell to about 5.0 v/cell for producing an acid solution containing dissolved transition metal while cathodically producing hydrogen gas. Such transition metals include nickel, cobalt, chromium, aluminum and copper. Such acids include sulfuric acid, fluoroboric acid, fluorosilicic acid, hydrochloric acid and nitric acid. As is the case with the ORNL nickel, the solution is preferably a sulfuric acid solution.

In a preferred practice, the technetium-contaminated transition metal is electrolytically dissolved in an acid solution which is maintained at a standard hydrogen potential (i.e., hydrogen half cell equal to zero) of at least about 0.3 volts so that the predominant technetium species in solution is the technetium (+7) ion rather than the technetium (+4) ion, which tends to form insoluble technetium oxide. The technetium-containing acid solution from the dissolution step is preferably contacted with an oxidizing agent selected from the group consisting of hydrogen peroxide, ozone, oxygen gas and nitric acid-nitrous acid mixtures to oxidize technetium (+4) in the acid solution to technetium (+7). Preferably, ozone or hydrogen peroxide is employed as an oxidizing agent where nickel is dissolved in sulfuric acid. Depending upon the oxidizing agent, the unreacted oxidizing agent in the acid solution from the oxidation step may be removed from the acid solution to protect downstream filters and ion exchangers from possible oxidation. In those practices where ozone is employed as an oxidizing agent, air or steam is preferably employed to strip the ozone from the acid solution following the oxidization step. In practices where hydrogen peroxide is employed as the oxidizing agent, ion exchange "blocking" may be used to remove residual impurities.

Following the dissolution of the transition metal into the acid solution, the pH of the solution is adjusted to between about 2.5 to about 4.5. The pH adjustment may be made by the addition of boric acid ($H_3BO_4$) or other suitable means. Advantageously, boric acid also functions as a plating agent to improve deposition character and to inhibit technetium deposition in a downstream electrowinning step. The metal-containing acid solution is filtered to separate particulates from the acid solution and thereby reduce the activity of the acid solution to less than about 50 Bq/cm. The particles may be colloidal sized particles stemming from the transition metal itself such as technetium oxide (in cases where, e.g., the redox potential of the acid solution is not continuously maintained) or processing contaminants such as resin fragments or the like.

The acid solution containing nickel ions and radionuclides then flows through an anionic exchanger and a cationic exchanger for sorbing anionic and cationic technetium complexes and other radioactive anions and cations and thereby reducing the activity of the acid solution to less than about 20 Bq/cm. In a preferred practice, the activity of the acid solution is verified after the filtration step and between each of the ion exchange steps in order to evaluate the condition of the processing equipment and the integrity of the process. If the activity of the acid solution is too high, the acid solution may be recycled before there is a significant build up of the in-process costs (and particularly the electrical costs associated with a downstream electrowinning step).

Importantly, the activity of the acid solution is verified after the ion exchange step so that a excessively contaminated acid solution is not fed to the electrowinning step. Acid solutions having activities of more than about 20 Bq/cm may result in highly contaminated plated transition metal which must be redissolved and completely reprocessed. It should be noted that recycling the acid solution for reworking to remove excessive contamination may add pennies per pound to the cost of the final product where completely reworking plated metal product will add dollars per pound to the operating cost. Where the activity of the acid solution from the ion exchange step is more than about 20 Bq/cm, the solution is recycled to upstream of the anion exchanger and the cation exchanger. Where the activity of the acid solution from the ion exchange step is less than about 20 Bq/cm, the metal-containing acid solution may be fed to an electrochemical cell for electrowinning the metal. In a preferred practice where nickel is to be electrowon from a sulfuric acid solution, the gross beta activity of the acid solution may be more than about 150 Bq/cm before the filtration step, less than about 20 after the filtration step and less than about 10 Bq/cm after the ion exchange step.

The transition metal-containing acid solution charged to the electrochemical cell is then electrowon at a voltage of about 2 v/cell to about 6 v/cell while anodically producing oxygen. Nickel electrowon from sulfuric acid solutions having a gross beta activity of less than about 10–20 Bq/gm may have technetium contamination levels of 2–17 Bq/gm or less.

The pH of the barren metal acid solution from the electrowinning step is reduced to less than about 2 and its standard hydrogen potential is preferably adjusted to at least about 0.3 volts so that the barren metal acid solution can be recycled to dissolve additional metal. The pH of the acid solution inherently decreases in the course of electrowinning as oxygen gas is generated. However, in a preferred practice of the invention, the inherent reduction in pH and the addition of acid to a recycle solution is employed to reduce the pH of the solution to 2 or less. Also, in a preferred practice, the redox potential of the recycled solution is adjusted by feeding the recycle solution to the oxidation step and the acid solution from the oxidation step is recycled to the electrolytic dissolution step for dissolving more contaminated transition metal.

BRIEF DESCRIPTION OF THE DRAWINGS

The invention as set forth in the claims will become more apparent from the following detailed description of a preferred practice thereof shown, by way of example only, in the accompanying process flow drawing of a process designed to decontaminate transition metals.

DESCRIPTION OF THE PREFERRED EMBODIMENT

Referring now to the process flow drawing in detail, there is shown a process particularly designed for decontaminating ORNL nickel. Thus, the present invention will be generally described in the context of decontaminating this material. However, as will be seen by those in the art, the process may be adapted to decontaminate other transition metals such as cobalt, chromium, aluminum, zinc and copper having gross beta activities greater than about 74 Bq/gm due to contamination by technetium and (usually) radioactive actinides. As is stated above, the ORNL nickel is contaminated with about 0.85 ppm technetium, less than about 0.5 ppb neptunium 237, less than about 0.005 ppb plutonium 239, about 0.93 ppm uranium 235 and 1.74 ppm total uranium and has a gross beta activity of about 4000 Bq/gm.

The ORNL nickel is generally available in the form of 24 inch diameter by 18 inch high 2,200 pound ingots, which must be converted to electrodes having a much higher surface area per unit weight geometry for effective electrolytic dissolution. Desirably, the electrode preparation involves a minimum amount of reprocessing, product losses and waste generation. Accordingly, contaminated feed electrodes are preferably prepared by "shot" production or thin sheet rolling from the contaminated ingots.

Shot production generally involves the steps of induction melting, screening, free-fall through a shot tower and collection. Induction melting is preferred over arc melting due to health physics constraints to control the spread and volatilization of any radio-contaminants. The product particle size should be sufficiently small that the product "flowers" can be loaded into titanium baskets for electrolytic dissolution. The chief advantages of a shot process are the generation of high surface area particles, ease of reloading and minimal rework. In addition, various known "slags" can be introduced during the melting operation to extract radiochemicals such as uranium and transuranics.

Planar electrodes may be produced by rolling thin sheets of thicknesses of about one quarter inch to about 2 inches to generate high surface areas. Planar electrodes may be preferred to "flowers" because anodic slimes which tend to form during the dissolution step can be more readily removed from planar anodes in most cases. In addition, a rolling process is inherently more simple than shot production and substantially eliminates dust control problems of shot production.

Once the electrode geometry is established, a suitable number of contaminated nickel electrodes 8 are loaded into a dissolution tank 10 in a "side-by-side" relationship. Up to 60 or more electrodes may be employed in the tank 10 shown. Half of the electrodes may be connected together as anodes and the other electrodes may be connected together as cathodes. Thus, inert cathodes need not (but could) be employed to complete an electrical circuit. The side-by-side contaminated electrodes preferably are connected to the dissolution process power supply through a reversing switch which alternates polarity on the electrodes so that each electrode spends half of its time as an anode and half as a cathode. The polarity may be reversed at 5 second to 30 second intervals. Preferably, the electrode polarity is reversed when the initial current flux drops by about 10% due to the rise in electrode polarization. Advantageously, concentration polarization is eliminated and anodic slimes are removed by the frequent polarity reversal. A voltage of between about 2 volts to about 5 volts is applied per cell, and preferably, about 3 volts, to dissolve the transition metal and the radioactive contaminants with the reduction of hydrogen to hydrogen gas at the cathodes. Gases and vapors from the tank 10 may be vented via an overhead hood 12 and piping 14 to an off gas scrubber (not shown). Also, the acid solution in the dissolution tank 10 may be recirculated by a pump through a carbon filter for removing slimes and particulates from the acid solution (not shown).

Preferably, nickel is dissolved into an acid solution having a pH of 0.5 to 2, and more preferably a pH of 1. The acid solution will typically contain at least about 60 g/l nickel because the acid solution is comprised of recycled acid solution from the electrowinning step, which generally does not economically plate nickel at substantially lower concentrations. Advantageously, anodic dissolution and hydrogen reduction are efficiently effected under these conditions. Preferably, the acid solution from the tank 10 contains from about 70 g/l to about 100 g/l nickel, and more preferably about 90 g/l nickel. The acid solution may have a gross beta activity of more than about 100 Bq/gm. Preferably (where nickel is to be decontaminated), the solution is sulfuric acid and contains from about 145 g/l to 245 g/l sulfate, and most preferably about 190 g/l sulfate. The acid solution may also contain up to about 30 g/l boric acid, which functions as a plating agent in the electrowinning step. The temperature of the acid solution may vary between 35° C. and 75 ° C. and preferably is about 60 ° C. Other transition metals such as cobalt, chromium, zinc, aluminum and the like, and other electrolytes, such as fluoroboric acid, fluorosilicic acid, hydrochloric acid, nitric acid and the like, and other suitable process conditions may be employed in other practices of the present invention.

Preferably, the redox potential of the acid solution in the dissolution tank 10 is maintained at about 0.3 volts so that the technetium (+4) species is oxidized to the technetium (+7) species. In a preferred practice of the present invention, the contaminated acid solution from the dissolution step is transferred by a pump 20 via a pipe 22 to an oxidation tank 24 where it is contacted with an oxidizing agent. The oxidizing agent may be ozone, hydrogen peroxide, oxygen, nitric-nitrous acid or the like. In a preferred practice where ozone is employed as the oxidizing agent, the acid solution from the oxidization tank 24 contains from 2 ppm to 10 ppm ozone. In the process shown, some of the acid solution in the oxidization tank 24 is recycled by a pump 26 in a pipe 28 and a second pipe 30 back to the dissolution tank 10 for maintaining the acid solution in the dissolution tank 10 at the proper redox potential.

The contaminated acid solution in the oxidization tank 24 may be transferred downstream via the pump 26 in the pipe 28 and another pipe 32 to a stripping tank 34 for removing unreacted oxidizing agents such as ozone from the acid solution by sparging regenerative air or steam supplied by a pipe 36 into the stripping tank 34. Alternatively, where hydrogen peroxide or the like is employed as the oxidizing agent, ion exchange "blocking" (not shown) may be employed in place of gas stripping to remove the unreacted oxidizing agent. Advantageously, removal of such unreacted oxidizing agents protects downstream equipment such as ion exchange resins and the like from oxidation.

The contaminated acid solution in the stripping tank 32 may be transferred via a pump 40 in a pipe 42 to a pH adjustment tank 44 where boric acid or other buffer may be added via a pipe 46 to the acid solution for adjusting the solution pH to between 2.5 and 4.5. Analysis of pilot plant operating data (for decontaminating ORNL nickel) indicates that the gross beta activity of the acid solution may be as high as about 150 Bq/gm at this point in the process.

The contaminated acid solution in the pH adjustment tank 44 may be pumped downstream by a pump 50 in a pipe 52 through a particulate filter 54 for removing radioactive particulates from the acid solution and thereby reducing the gross beta activity of the acid solution to about 20 Bq/gm or less. Preferably, the filter 54 is a hybrid sand-powdered ion exchange resin filter. In a preferred practice, the filter 54 is a downflow filter with a layer of sand over a layer of powdered ion exchange resins having a fabric mesh extending horizontally through the resin.

The contaminated acid solution may be transferred downstream via a pump 56 in a pipe 58 through one or more anion exchangers 60, cation exchangers 62 and, preferably, mixed ion exchangers 64 (which are shown as one exchanger each) to one of two hold tanks 66. Preferably, sulfate resins are employed at a operating temperature of less than about 60°C. Mixed ion exchangers 64 may be advantageously employed to eliminate the effects of any localized pH variations that may occur in a pure anion or cation column. Advantageously, both radioactive anions and cations may be sorbed from the acid solution. Analysis of pilot plant operating data (for decontaminating ORNL nickel) indicates that the gross beta activity of the solution after the anion exchangers 60 may be as low as 10 Bq/gm and as low as 8 Bq/gm after the cation exchangers 62 where the gross beta activity of the acid solution before filtration step is as high as 150 Bq/gm.

Preferably, at least two anion exchangers 60, cation exchangers 62 and mixed ion exchangers 64 are employed on-line in series. Each on-line ion exchanger 60, 62, and 64 is monitored to determine radiochemical activity breakthrough. When the first (i.e., the upstream) ion exchanger bed in tandem breaks through, it is taken off-line and regenerated while the second bed in tandem is "moved-up" to the first position and a fresh bed is installed in the second position.

The radioactivity of the acid solution in the hold tanks 66 is verified before charging the solution to the downstream electrowinning step. If the gross beta activity exceeds about 20 g/l the acid solution may be recycled via a pump 70 in a pipe 72 and a pipe 74 to upstream of the anion exchanger 60. Preferably, the recycled acid solution is returned to the oxidation tank 24 for adjusting its redox potential to assure complete oxidization of technetium to the technetium (+7) species. If the gross beta activity is less than about 20 Bq/gm, the acid solution may be transferred via the pump 70 and pipe 76 to an electrowinning tank 80. More preferably, the acid solution is not charged to the electrowinning tank 80 unless its gross beta activity is less than about 10 Bq/gm. In a preferred practice of the present invention, and after the gross beta activity of the acid solution in a hold tank 66 has been verified to be below about 20 Bq/gm, the pH of the solution may be buffered with boric acid or other suitable buffer to between about 4.0 and 4.5 before charging the solution to the electrowinning step.

The electrowinning tank 80 is operated at about 2 volts/cell to about 6 volts/cell, and preferably at about 3 volts/cell to plate nickel product at the cathode while generating oxygen gas at the anode. The electrowinning tank 80 as shown has three cells with about 20 anodes per cell, although other configurations may be employed. Inert anodes must be employed to maintain clean electrolytes in the electrowinning step. Thus, commercially available titanium anodes coated with a platinized layer or an iridium oxide layer are preferably employed. Conventional graphite electrodes are not acceptable as they tend to spall submicron particles into the solution which may adsorb technetium complexes, pass through ion exchangers and then be adsorbed on the cathode product. Also, "inert" stainless steel anodes preferably are not employed because they contaminate the plating bath with chromium, which tends to inhibit plating by increasing the surface stresses on the cathodic deposits. Analysis of pilot plant data (for decontaminating ORNL nickel) indicates that nickel plated in accordance with this practice have beta activities due to technetium of from 1.6 Bq/gm to 17.0 Bq/gm or less.

The off gases from the electrowinning tank 80 may be vented via a hood 82 and piping 84 to a gas scrubber or other waste treatment facility (not shown). In addition, the acid solution in the electrowinning tank 80 may be conventionally recirculated by centrifugal pumps through external carbon filters for removing particulates in the solution (not shown).

The barren acid solution from the electrowinning tank 80, now containing about 60 g/l to about 75 g/l nickel and up to about 30 g/l boric acid is transferred via a pump 86 in a pipe 88 to a recycle tank 90 for recycling the barren acid solution to dissolve additional contaminated nickel. The barren acid solution will inherently have a lower pH than does the acid solution charged to the electrowinning tank 80 because of the electrowinning step. Preferably, sulfuric acid or other suitable acid is added via a pipe 92 to the barren acid solution in the recycle tank 90 in order to further reduce the approximate pH of the acid solution to the pH of the acid solution in the dissolution step, which is about 0.5 to about 2. In addition, and is shown, the barren acid solution is preferably transferred via a pump 94 in a pipe 96 back to the oxidation tank 24 (for adjusting the redox potential of the recycled acid solution to about 0.3 volts) and then to the dissolution tank 10 via pipe 26.

Accordingly, the technical risks of product contamination are managed by an effective process screen (comprising a particulate filter for trapping technetium oxide colloidal sized and larger particles out of aqueous acid solutions, and an anion exchanger and a cation exchanger for trapping both positive and negative pertechnetate complexes) between the dissolution step and the electrowinning step and recycling of all excessively contaminated solutions to upstream of the screen. Importantly, the decontamination is verified at the process screen before the electrowinning step.

While a present preferred embodiment of the present invention has been shown and described, it is to be understood that the invention may be otherwise variously embodied within the scope of the following claims of invention.

What is claimed is:

1. A process for decontaminating a transition metal contaminated with technetium, comprising the steps of:

electrolytically dissolving a technetium-contaminated transition metal having a gross beta activity of at least about 74 Bq in an acid solution having a pH between about 0.5 and 2.0 at a voltage of about 2.0 v/cell to about 5.0 v/cell for producing an acid solution containing the dissolved transition metal and contaminated with technetium while cathodically producing hydrogen gas, the metal selected from the group consisting of nickel, cobalt, chromium, aluminum, zinc and copper, and the acid solution selected from the group consisting of sulfuric acid, fluoroboric acid, fluorosilicic acid, hydrochloric acid and nitric acid;

oxidizing technetium (+4) in the transition metal-containing acid solution to technetium (+7);

adjusting the pH of the technetium-containing acid solution to between about 2.5 to about 4.5;

filtering particulates from the acid solution for reducing the gross beta activity of the acid solution to less than about 50 Bq/gm;

sorbing radioactive ions in an anionic exchanger and a cationic exchanger for reducing the gross beta activity of the acid solution to less than about 20 Bq/gm;

verifying the gross beta activity of the acid solution;

recycling acid solution having an activity of more than about 20 Bq/gm to upstream of the anion exchanger and the cationic exchanger;

electrowinning transition metal from acid solution having a gross beta activity of less than about 20 Bq/gm at a voltage of about 2 v/cell to about 6 v/cell while anodically producing oxygen gas;

reducing the pH of barren metal acid solution from the electrowinning step to less than about 2; and recycling the barren metal acid solution to the dissolution step for dissolving additional metal.

2. The transition metal decontamination process of claim 1, wherein the transition metal is nickel.

3. The transition metal decontamination process of claim 2, wherein the nickel is dissolved into sulfuric acid.

4. The transition metal decontamination process of claim 1, wherein the technetium (+4) in the transition metal-containing acid solution is oxidized to technetium (+7) by: contacting the technetium-containing acid solution with an oxidizing agent selected from the group consisting of hydrogen peroxide, ozone, oxygen gas and nitric acid-nitronic acid mixtures.

5. The transition metal decontamination process of claim 4, comprising the additional step of removing unreacted oxidizing agent from the acid solution after the oxidizing step and before the filtration step.

6. The transition metal decontamination process of claim 4, wherein the standard hydrogen potential of the acid solution is about 0.3 v before filtering.

7. The transition metal decontamination process of claim 1, including the further step of: contacting the recycle solution with an oxidizing agent selected from the group consisting of hydrogen peroxide, ozone, oxygen gas and nitric acid-nitronic acid mixtures for preventing the reduction of technetium (+7) to technetium (+4) in the recycle solution.

* * * * *